US005697830A

United States Patent [19]

White

[11] Patent Number: 5,697,830

[45] Date of Patent: Dec. 16, 1997

[54] NURSING BRASSIERE WITH SHORTENED SUPPORT WIRE

[76] Inventor: Barbara E. White, 572 Roosevelt Way, San Francisco, Calif. 94114

[21] Appl. No.: 692,750

[22] Filed: Aug. 6, 1996

[51] Int. Cl.[6] ..... A41C 3/04; A41C 3/10

[52] U.S. Cl. ..... 450/36; 2/104; 2/73; 450/41; 450/70; 450/66

[58] Field of Search ..... 2/73, 104, 105, 2/106, 113, 115, 46; 450/1, 36, 58, 41, 42, 43, 44, 45, 46, 47, 48, 49, 50, 51, 52, 53, 66, 70, 72, 83, 79, 80, 82, 84, 85, 86

[56] References Cited

U.S. PATENT DOCUMENTS

| | | | |
|---|---|---|---|
| 137,724 | 4/1873 | Russell | 450/58 X |
| 1,989,303 | 1/1935 | Alberts | 450/41 |
| 2,706,816 | 4/1955 | Dozier | 2/104 X |
| 4,550,734 | 11/1985 | Porco | 450/36 |
| 4,633,876 | 1/1987 | Scullin | 450/36 |
| 4,911,677 | 3/1990 | White | 2/104 X |
| 5,378,192 | 1/1995 | Darmante | 450/58 |
| 5,401,203 | 3/1995 | Fildan | 450/41 |
| 5,461,725 | 10/1995 | Witezak | 2/104 |

FOREIGN PATENT DOCUMENTS

| | | | |
|---|---|---|---|
| 1146838 | 3/1969 | United Kingdom | 450/41 |

*Primary Examiner*—Jeanette E. Chapman

*Attorney, Agent, or Firm*—Owen, Wickersham & Erickson, P.C.

[57] ABSTRACT

A nursing brassiere that provides added support and yet can be easily manipulated to provide nursing access is disclosed The brassiere has overlapping frontal portions each with a cup-like configuration for covering the wearer's breasts. The frontal portions are attached to a lower elastic or elastic type cut and sewn portion below the breasts which includes a wrap-around band. Along a lower outer border of each cup-like frontal portion is a relatively short arcuate wire member that provides breast support under normal wear conditions. When nursing takes place, a frontal portion is easily pulled aside to displace the supporting wire and expose the breast for the necessary nursing access.

2 Claims, 2 Drawing Sheets

NURSING BRASSIERE WITH SHORTENED SUPPORT WIRE

This invention relates to an improved nursing brassiere, and more particularly to a brassiere that affords increased support yet easy access during nursing.

BACKGROUND OF THE INVENTION

In my prior U.S. Pat. No. 4,911,671 a relatively simple but highly useful nursing brassiere is disclosed which includes the combination of cross-over frontal portions and an attached wrap-around band arrangement. Although this patented brassiere has been widely accepted and used, it has become apparent that for a significant percentage of mothers, particularly those of heavier stature, a brassiere with additional support was more desirable if not, essential. In conventional non-nursing brassieres it has been known to use embedded wire members to provide the additional strength necessary to maintain adequate breast support. Such wires were generally arcuate and close to if not fully semi-circular so as to fit permanently under the breast. However, it was not feasible or desirable to use such semi-circular wires in nursing brassieres because of the necessity to manipulate the brassiere cup portion in order to provide breast access during nursing.

It is therefore an object of the present invention to solve the aforesaid problem by providing a nursing brassiere that supports the wearer's breasts during normal wear and yet can be easily manipulated to provide breast access during a nursing procedure.

Another object of the invention is to provide a nursing brassiere having a pair of frontal portions attached to a lower wrap around portion, each of said frontal portions having an arcuate wire support to support the wearer's breast during normal wear and yet being movable to provide breast access for nursing.

Another object of the invention is to provide a nursing brassiere that is particularly well adapted for ease and economy of manufacture.

SUMMARY OF THE INVENTION

According to the principles of the invention a nursing brassiere is provided which comprise a pair of overlapping frontal or cup portions made of relatively flexible cloth material. Each frontal portion has a shoulder strap and extends downwardly to form a wider portion that covers one of the wearer's breasts. The lower edge of each frontal portion is sewn to a lower wrap-around portion of somewhat stiffer material which extends around the wearer's body below the breasts. Fixed in place within a seam between each frontal portion and the lower wrap-around portion is an arcuate wire which fits under and supports a breast when the brassiere is worn normally. Each arcuate wire has a length which subtends an angle of around 90° and is located near the outer side of a frontal portion. Thus, the arcuate wires provide a significant amount of support under the breasts when the brassiere is worn normally. When nursing takes place one frontal portion may be pulled outwardly to expose the breast while simultaneously moving the arcuate wire outwardly and away from the breast. After nursing the frontal portion and attached reinforcing wire resume their normal supporting position.

Other objects, advantages and features will become apparent from the following detailed description of one embodiment taken in conjunction with the accompanying drawing.

DETAILED DESCRIPTION OF EMBODIMENT

Figure 1:
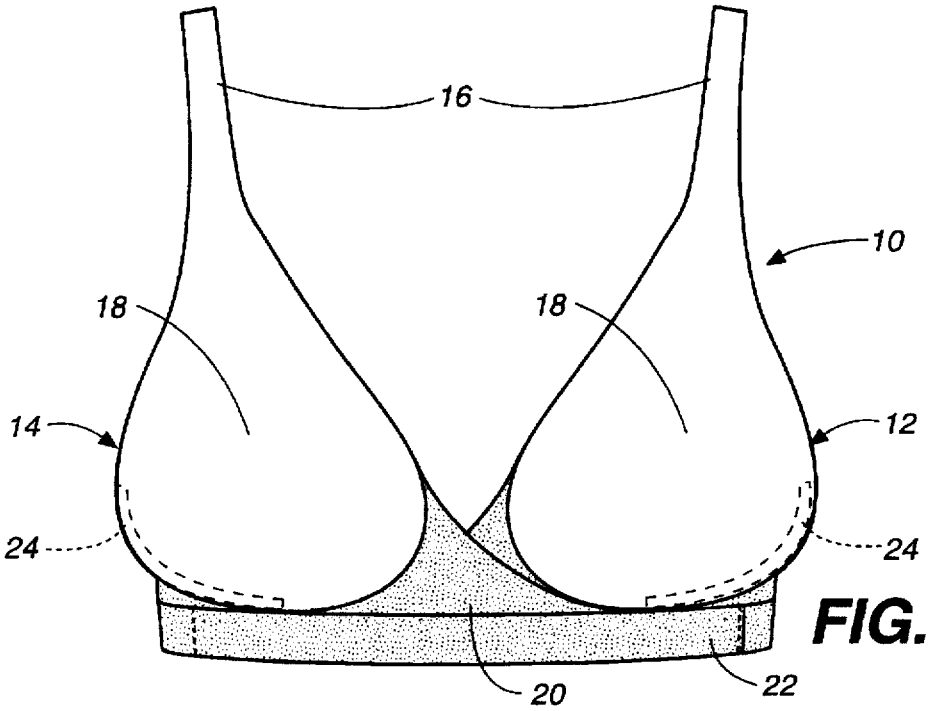
FIG. 1 is a front view in elevation showing a nursing brassiere embodying principles of the present invention.

With reference to the drawing, FIG. 1 shows a nursing brassiere 10 embodying principles of the present invention which provides increased support for the wearer and yet can be easily and conveniently manipulated to provide breast access during a nursing procedure.

In general, the brassiere 10 comprises a pair of frontal portions 12 and 14 which cover the wearer's breast and overlap between them. Each frontal portion has an upper shoulder strap 16 which connects with a generally triangular cup-like lower portion 18. Both frontal portions are preferably made from a relatively flexible cloth material of a type commonly used for brassieres. Along the bottom edge of each frontal portion it is stitched to a lower portion 20 which includes a belt-like extension 22 that extends around the wearer's torso.

Figure 1A:
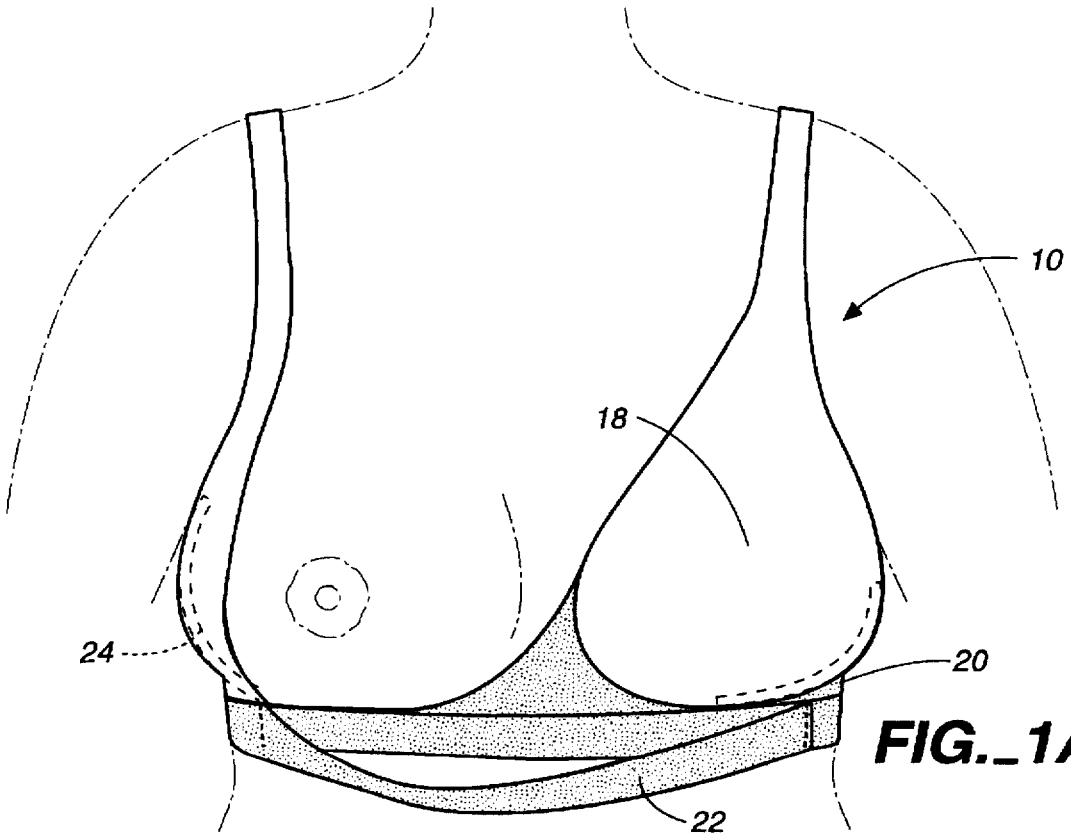
FIG. 1A is a front view in elevation showing the brassiere of FIG. 1 as it appears when in use for nursing on a wearer (shown in phantom).
Figure 2:
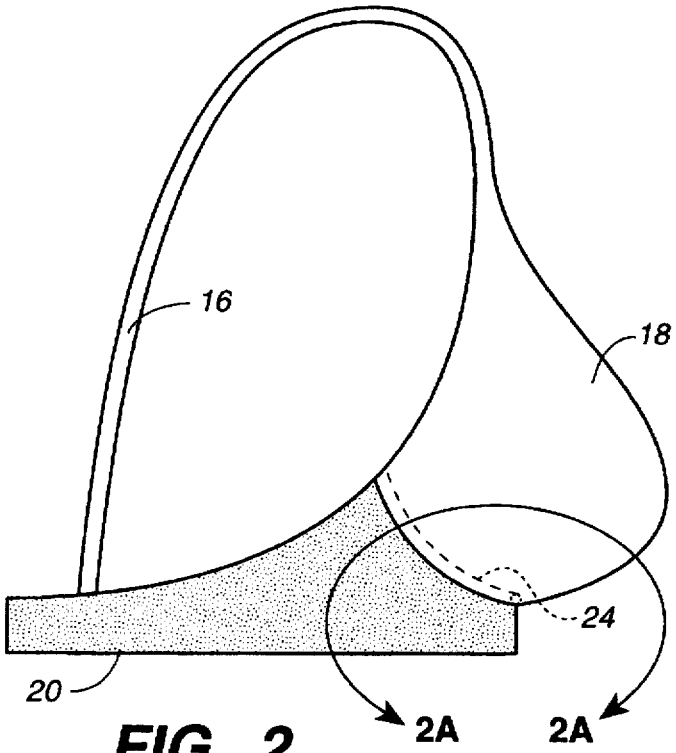
FIG. 2 is a side view in elevation of the brassiere of FIG. 1.

As shown by the dotted lines in FIGS. 1 and 1A an arcuate support wire 24 is stitched in place along a lower edge of each frontal portion near its outer side. Each arcuate support wire 24 subtends an angle of no greater than 90° and has a radius of around four inches to eight inches. Preferably, each support wire is stitched in place along the lower, outer edge of a frontal portion so that it extends under and along the outer portion of the wearer's breast, as shown in FIGS. 2 and 2A.

Figure 3:
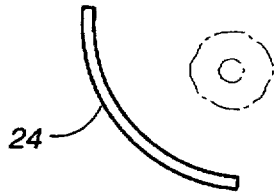
FIG. 3 is a front view of the support wire use in the brassiere of FIGS. 1 and 2.
Figure 3A:
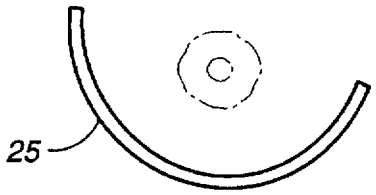
FIG. 3A (PRIOR ART)
FIG. 3A is a front view of a support wire used on prior art brassieres.
Figure 2A:
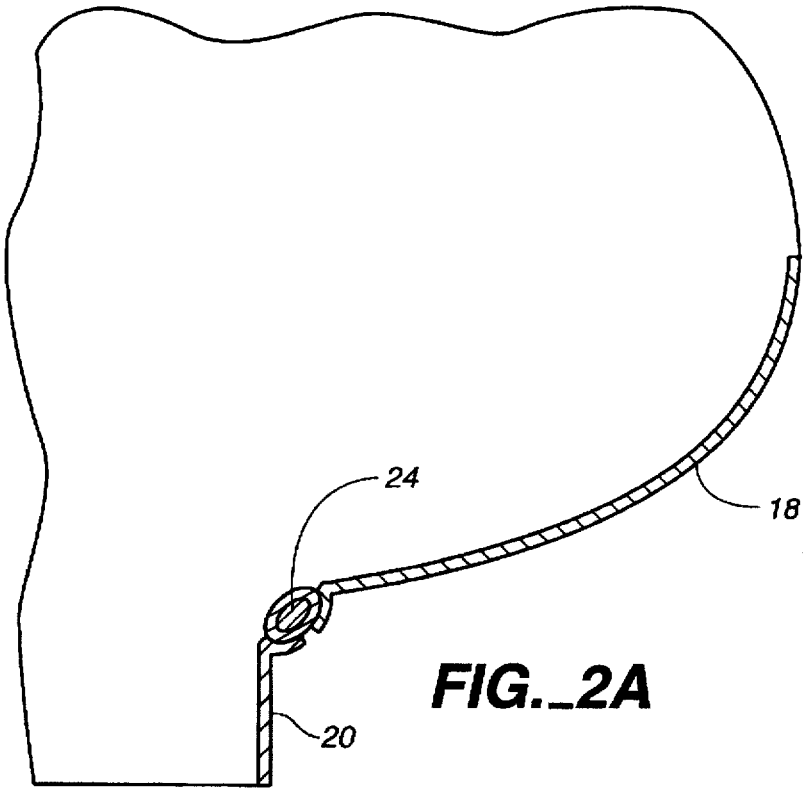
FIG. 2A is a fragmentary view in section taken along the line 2A—2A of FIG. 2.

Each arcuate support wire 24 has preferably a somewhat oval cross-section, as shown in FIG. 2A, and may vary somewhat in length depending on the brassiere size. However, as stated above and shown in FIG. 3, the arc of each wire 24 for the brassiere subtends an angle no greater than 90°, which is contrary to a conventional support wire 25 previously used in non-nursing brassieres, as shown in FIG. 3A.

The shoulder straps 16 of the brassiere may be connected to rear side of the lower portion 20 in any suitable manner. The lower portion 20 may itself be made of a stretchable, elastic material so as to accommodate a range of wearer sizes. The belt-like end portion extension 22 may be provided with a suitable end attachment so as to enable it to be adjusted for tightness when necessary.

More, specifically, the brassiere includes a pair of frontal cup portions 18 of a generally triangular shape with a relatively narrow upper end and a relatively wide lower end having a lower edge adapted to extend just below the wearer's breast. Each cup portion also includes an inner end near the lower edge and an outer side edge extending from the opposite end of the lower edge. An extended lower portion of material 20 is connected to the outer side edge of each cup portion. A shoulder strap 16 is connected between an upper end of each cup and each extended portion 20. There also exist a means for connecting portions 20 together at the back of the wearer. The belt like extension, an elongated stretchable member, 22 is attached to the lower edge of each cup portion. Each stretchable member includes one end attached to the inner end of each cup and the other end attached to another portion of the cup. The brassiere includes an arcuate support wire 24 attached to the outer side edge of each cup and each wire extends along a portion of the lower edge of each cup. The support wire 24 includes a curved shape with a length no greater than eight inches.

In use, the brassiere 10, with the frontal portions 12 and 14 and their wire supports 24 provides a firm comfortable support for the wearer. When it becomes necessary for the wearer to nurse, one frontal portion 12, as shown in FIG. 2A is merely pulled toward the outside of the wearer's body to expose the breast. As the frontal portion is pulled aside, the wire support 24 moves outwardly and away from the breast without interference, and when nursing is complete, the elasticity of the lower portion 20 moves the frontal portion and the wire support back to its supporting position.

To those skilled in the art to which this invention relates, many changes in construction and widely differing embodiments and applications of the invention will make themselves known without departing from the spirit and scope of the invention. The disclosure and the description herein are purely illustrative and are not intended to be in any sense limiting.

What is claimed is:

1. A nursing brassiere adapted to be worn on the upper body of a woman to support her breasts during normal wear periods and to provide easy access to either breast during nursing periods, said brassiere comprising:

a pair of frontal cup portions of flexible material adapted to cover a wearer's chest area, each frontal cup portion having a generally triangular shape with relatively narrow upper end and a relatively wide lower end having a lower edge adapted to extend just below the wearer's breast, each said cup portion also having an inner end near said lower edge and an outer side edge extending from the opposite end of said lower edge;

an extended portion of material connected to said outer side edge of each said frontal cup portion, and a shoulder strap means connected between said upper end of each said frontal cup portion to its said extended portion, and means for connecting said extended portions of each said frontal cup portion at the back of the wearer;

an elongated stretchable member attached to said lower edge of each said frontal cup portion, each said stretchable member having one end attached to said inner end of each said frontal cup portion and having its other end attached to an other frontal cup portion;

an arcuate support wire attached to the outer side edge of each frontal portion and extending along a portion of its lower edge, each said support wire having a curved shape with a length no greater than eight inches, so that the support wires will provide increased breast support during normal wear; whereby when one frontal cup portion with its support wire is moved generally laterally by the wearer relative to the other frontal cup portion, said stretchable member will elongate to enable the frontal cup portion to move outwardly and away from the wearer's breast to expose it for nursing, and when released, it will return to its breast supporting position.

2. The nursing brassiere as described in claim 1 wherein each said arcuate support wire subtends an angle of around 90° and has an arcuate radius of from four to eight inches.

* * * * *